United States Patent [19]

Larsen et al.

[11] 4,453,480

[45] Jun. 12, 1984

[54] THREAD TENSIONING MODULE FOR A SEWING MACHINE

[75] Inventors: Robert H. Larsen, Middletown, N.J.; Anthony Giaimo, Staten Island, N.Y.

[73] Assignee: The Singer Company, Stamford, Conn.

[21] Appl. No.: 512,849

[22] Filed: Jul. 11, 1983

[51] Int. Cl.[3] ..... D05B 47/02

[52] U.S. Cl. ..... 112/254; 242/149

[58] Field of Search ..... 112/254, 255, 59, 97; 66/146; 242/150 R, 149

[56] References Cited

U.S. PATENT DOCUMENTS

| | | |
|---|---|---|
| 119,589 | 10/1871 | Estabrooke . |
| 3,557,731 | 1/1971 | Casas-Robert . |
| 3,667,414 | 6/1972 | Illes et al. . |
| 3,927,631 | 12/1975 | Kuhar . |
| 4,111,140 | 9/1978 | Gonnai et al. . |
| 4,141,306 | 2/1979 | Weber . |
| 4,180,006 | 12/1979 | Ross . |
| 4,372,502 | 2/1983 | Larsen et al. ..... 112/254 |

OTHER PUBLICATIONS

U.S. patent application Ser. No. 246,531, filed Mar. 23, 1981, of Robert H. Larsen and Anthony Giaimo.

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A thread tensioning module for use on a sewing machine is provided with a plastic housing and with mechanism at the rear of the housing for receiving and applying frictional resistance to the movement of thread therethrough. The mechanism includes a pair of thread engageable members, one of which extends beyond the other and the side wall of the module on the thread entering side thereof to catch and enable thread to be positioned between the members.

10 Claims, 8 Drawing Figures

THREAD TENSIONING MODULE FOR A SEWING MACHINE

DESCRIPTION

Background of the Invention

1. Field of the Invention

The invention relates to thread tensioning devices of the kind which are found on sewing machines, and with which an operator can control tension in the thread used in sewing operations.

2. Description of the Prior Art

Adjustable thread tensioning devices for use in controlling the tension in needle thread on a sewing machine are well known. Examples of such devices are disclosed in U.S. Pat. No. 4,356,781 of Donald Rodda for "Thread Handling Arrangement for Sewing Machines", issued Nov. 2, 1982 and in U.S. Pat. No. 4,372,502 of Robert H. Larsen and Anthony Giaimo for "Adjustable Thread Tensioning Device for a Sewing Machine", issued Feb. 8, 1983.

The prime object of the present invention is to combine thread tensioning mechanism and a cover therefor into a self-threading modular unit for use in a sewing machine.

It is another object of the invention to provide a thread tensioning module as described with a linearly movable tension modulating control knob, and means effective to indicate to a machine operator when the knob is in a preferred tension selecting position.

It is also an object of the invention to provide a thread tensioning module as described facilitating the testing and adjustment of thread tensioning mechanism apart from a sewing machine.

Other objects and advantages of the invention will become apparent during a reading of the specification taken in connection with the accompanying drawings.

SUMMARY OF THE INVENTION

Thread tensioning mechanism and a housing therefor are combined into a thread tensioning module for use on a sewing machine. The thread tensioning mechanism is mounted at the rear of the housing and serves to apply frictional resistance to the movement of thread therethrough. Such mechanism includes a pair of thread engageable members, one of which projects beyond the other and beyond a side wall of the housing on the thread entering side of the module to catch and enable thread to be positioned between the members. A linearly movable control knob at the front of the housing operably connects through the housing with said mechanism and is positionable along the housing for predetermining the magnitude of frictional resistance exertable by the mechanism on the thread. The resistance to movement of the control knob is increased at a defined location of the knob to indicate a preferred tension selecting position for the knob to a machine operator.

DESCRIPTION OF THE PREFERRED EMBODIMENT

Figure 1:
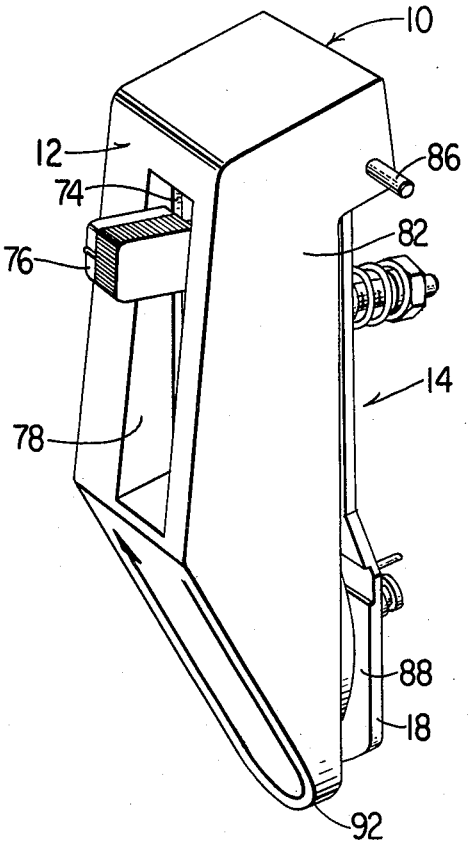
FIG. 1 is a perspective view of the thread tensioning module of the invention.
Figure 2:
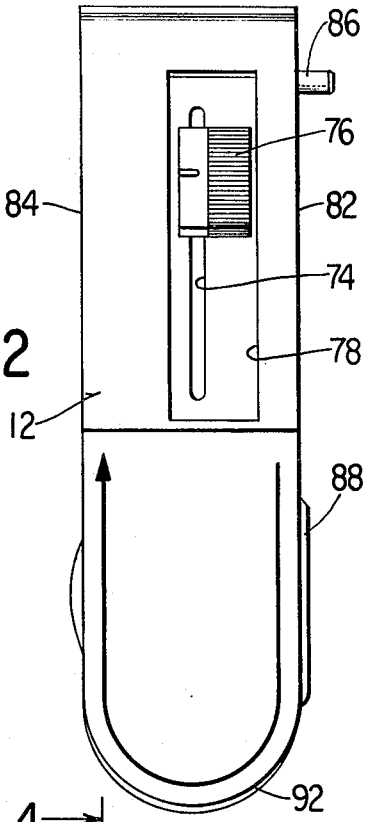
FIG. 2 is a front view of the module.
Figure 4:
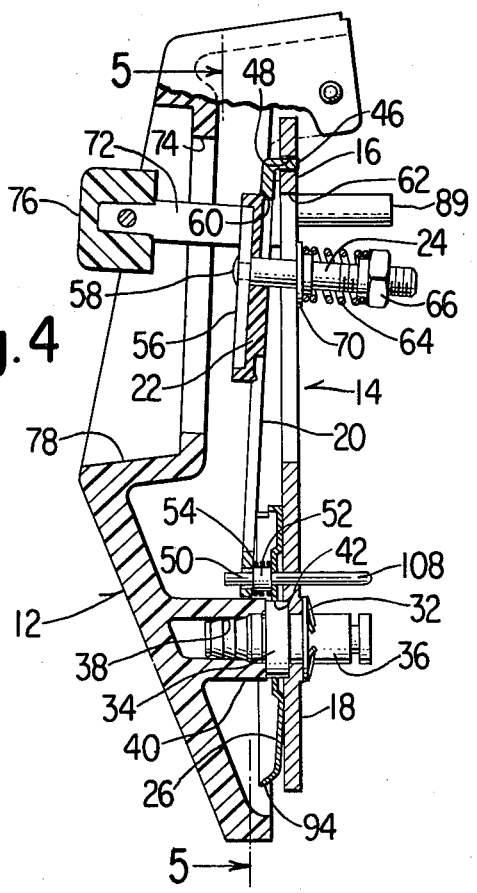
FIG. 4 is a vertical sectional view taken on the plane on the line 4—4 of FIG. 3.
Figure 3:
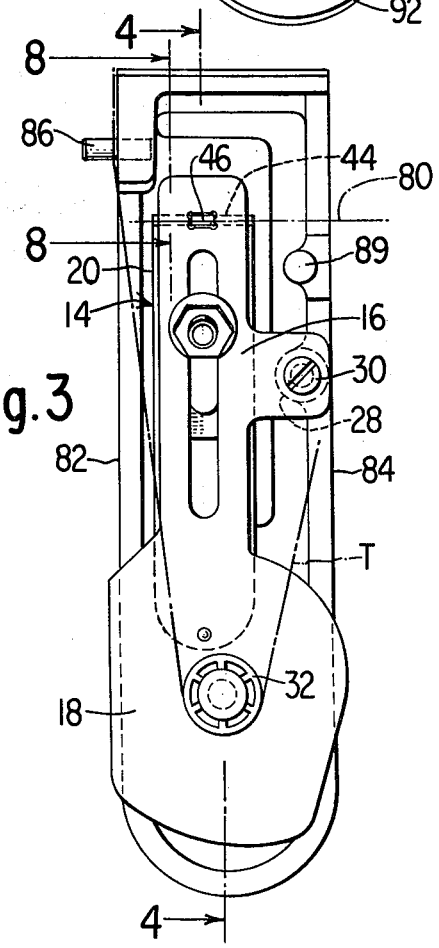
FIG. 3 is a rear view of the module.
Figure 5:
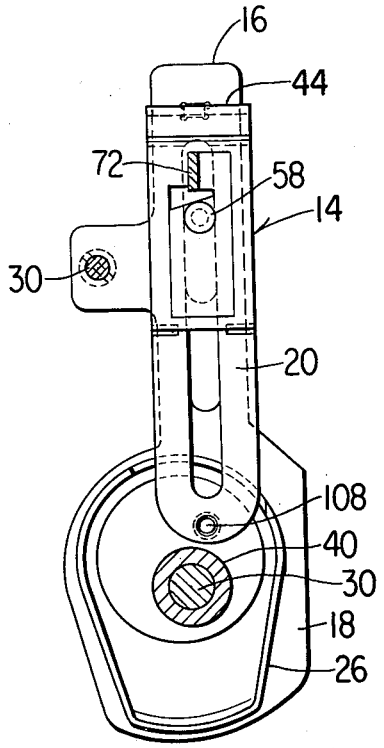
FIG. 5 is a view taken on the plan of the line 5—5 of FIG. 4.
Figure 7:
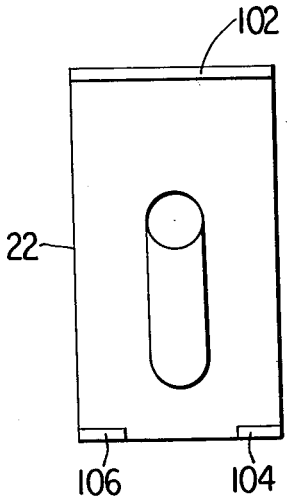
FIG. 7 is a plan view of the underside of a slide block.
Figure 6:
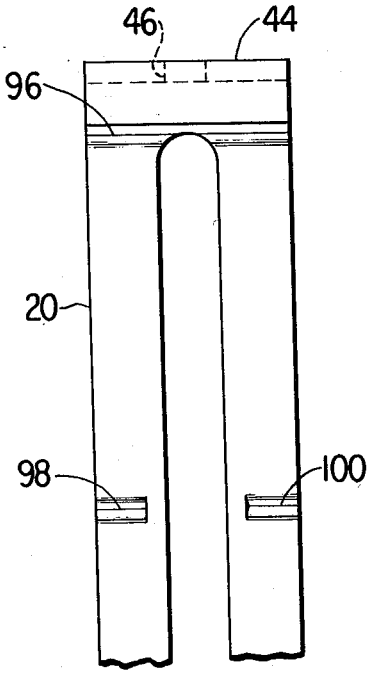
FIG. 6 is a fragmentary plan view showing a slide engaged surface of a tension lever.
Figure 8:
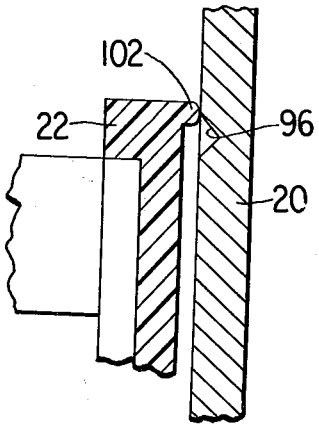
FIG. 8 is an enlarged fragmentary sectional view on the plane of the line 8—8 of FIG. 3.

Referring to the drawings, reference character 10 designates a thread tensioning module including a plastic housing 12 which is attachable to a sewing machine, and including mechanism 14 mounted at the rear of the housing 10 for applying frictional resistance to thread used in sewing operations on the machine. Mechanism 14 includes an elongate fixed member 16 which terminates in a thread engageable plate-like part 18, an elongate pivotally movable member 20, a slide block 22, positionable along member 20, a spring biased member 24 which acts through block 22 to urge member 20 toward member 16, and a floating disc-like thread engageable member 26 located opposite the plate-like terminal part 18 of member 16.

As shown, member 16 is affixed between the ends thereof to a boss 28 on housing 12 with a screw 30. Plate-like terminal part 18 of the member is held with a retaining ring 32 against the flanged portion 34 of a post 36 affixed at 38 in a housing boss 40 and extending through part 18. Flanged portion 34 of post 36 extends though an opening 42 in floating disc-like member 26 and serves as a guide therefor.

Elongate member 20 is formed on a turned down end 44 with a projecting tab 46 which extends into a somewhat loosely accommodating through opening 48 in member 16 to pivotally mount member 20 on the fixed member 16. A pin 50 extends through member 20 at the end opposite from turned down end 44. The pin is slidable in disclike member 26 and in plate-like part 18 of member 16. Pin 50 includes a boss 52 which rests on member 20 and is normally caused to engage the underside of disc-like member 26. A weak helical compression spring 54 extends about the pin between member 20 and 26.

Slide block 22 which is preferably a plastic part has a metal plate 56 fixedly embedded therein. Member 24 is affixed to the plate 56 at 58 and extends through aligned slots 60 and 62 in members 20 and 16 respectively. A compression spring 64 extending about member 24 between a nut 66 and a washer 70 in engagement with fixed member 16 causes slide block 22 to forcibly bear against member 20 and urge member 20 toward fixed member 16. Member 20 acting through boss 52 on pin 50 causes disc-like member 26 to be urged against plate-like part 18 of member 16.

Plate 56 includes an integral arm 72 which extends through a slot 74 in plastic housing 12 to receive a control knob 76. The knob can be moved in an elongate recess 78 in the housing to change the position of slide block 22 on member 20 and of member 24 in slots 60 and 62. Downward movement of the knob in recess 78 increases the distance between slide block 22 and the pivotal axis 80 of member 20, and results in disc-like member 26 being urged with increasing force against the plate-like part 18 of member 16. Upward movement of knob 76 decreases the distance between block 22 and axis 80 to lessen the force with which member 26 is urged against part 18. Tension in any sewing thread T pulled between member 26 and part 18 of member 16 is dependent upon the frictional resistance exerted on the thread by the thread engaging members and is therefor selectively determinable according to the position of the control knob 76.

Housing 12 is formed with mutually parallel planar side walls, that is side wall 82 on the thread entering side of module 10, and side wall 84 on the thread exiting side. A fixed thread guiding pin 86 extends outwardly from an upper part of side wall 82, and a marginal edge portion 88 of part 18 projects outwardly from a lower part of wall 82. The housing includes an integral post 89. Such post 89 along with post 36 which is affixed in housing boss 40 enables the module 10 to be readily attached to a sewing machine, it only being necessary to apply a retaining ring or spring clip fastener to the posts after they have been inserted through holes in supportive structure on the machine.

Thread T, from a supply spool on the sewing machine, is directed into the module 10 by way of pin 86 and marginal edge portion 88 of part 18. The thread is first led over pin 86 and down along side wall 82 to the lower portion where it is caught by marginal edge portion 88 of part 18. The thread is then led about the bottom of curved edge 92 of the module and upwardly as toward thread take-up mechanism in the machine. As the thread is moved about curved edge portion 92 and then upwardly, it moves into a position between disc-like member 26 and part 18 with an accompanying very slight enforced displacement of member 26 against the bias of spring 54. Movement of the thread into a position between member 26 and part 18 is facilitated by a turned down angularly extending bottom edge portion 94 of member 26.

As already noted, thread tension depends upon the position selected by a machine operator for control knob 76. There is, however, a preferred tension selecting position for the control knob at which most sewing operations can be satisfactorily performed. Such preferred position is defined by V-shaped grooves 96, 98 and 100 in member 20 and depending protuberances 102, 104 and 106 in slide block 22. The grooves 96, 98 and 100 receive protuberances 102, 104 and 106, respectively, when the knob is disposed in the preferred position, and there is thereby provided a "detent feel" indicating the position of the knob to an operator. Movement of the knob 76 out of the preferred position is accomplished with somewhat greater upward or downward force thereon than is required to move the knob from some other location. Since grooves 98 and 100 extend only part way across member 20, they cannot receive protuberance 102, and do not provide a "detent feel" for knob 76 in a lowered position wherein such protuberance and the grooves 98 and 100 are aligned. A quick release of tension on thread extending between member 26 and part 18 may be effected by applying axial pressure to the end 108 of pin 50 with operably connected mechanism (not shown) under the control of a machine operator.

Before the module is installed in a machine, nut 66 may be adjusted on member 68 to provide for a desired thread tension in the preferred position of control knob 76. Before being so installed, the device may be also tested to ascertain if all of the functioning parts operate correctly, and then reworked if it should prove necessary, all without interfering with work which may have to be performed on the machine which is to receive the module.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be within the scope of the appended claims.

We claim:

1. A thread tensioning module for a sewing machine, said module including a housing which is attachable to the machine, mechanism mounted at the rear of the housing for receiving thread and applying frictional resistance to the movement thereof during a sewing operation, a linearly movable control knob at the front of the housing operably connected through the housing with said mechanism and positionable along the housing for predetermining the magnitude of frictional resistance exertable by said mechanism on the thread, the housing having side walls one of which is on the thread entering side of the module and the other of which is on the thread exiting side, the said mechanism including a pair of friction applying thread engageable members, one of which projects beyond the other and beyond the housing side wall on the said one side of the module to catch and enable thread to be positioned between the members.

2. A thread tensioning module according to claim 1 including means for increasing resistance to the movement of the control knob along the housing at a defined location of the knob to thereby indicate a preferred tension selecting position for the knob to an operator.

3. A thread tensioning module according to claim 1 wherein one of the thread engaging members is a floating disc and the other member is affixed to the housing.

4. A thread tensioning module according to claim 3 wherein said other member is an elongate part which terminates in a plate-like thread engaging portion, and which is affixed between the ends of the member to said housing.

5. A thread tensioning module according to claim 1 wherein the thread catching member is affixed to the housing and the other member is slidably mounted on a post which is affixed in the housing.

6. A thread tensioning module according to claim 5 wherein the slidably mounted member has a turned down lip to facilitate the movement of thread into an position between the plates.

7. A thread tensioning module according to claim 5 wherein the post is a machine mounting member for use in securing the module to structure of the sewing machine.

8. A thread tensioning module according to claim 1 wherein the side walls of the module are substantially parallel and planar.

9. A thread tensioning module according to claim 8 including a thread guiding pin extending laterally from the side wall on the thread entering side of the module.

10. A thread tensioning module according to claim 1 wherein the housing is of a plastic material.

* * * * *